United States Patent [19]

Johnson et al.

[11] Patent Number: 4,709,829

[45] Date of Patent: Dec. 1, 1987

[54] SAN-I-CAN (A BEVERAGE CONTAINER INCORPORATING ITS OWN STRAW)

[76] Inventors: Lee R Johnson; Lee K. Johnson, both of P.O. Box 415, Avon, Mont. 59713

[21] Appl. No.: 902,949

[22] Filed: Sep. 2, 1986

[51] Int. Cl.[4] ..... A47G 19/22

[52] U.S. Cl. ..... 220/90.2; 229/7 S; 215/1 A

[58] Field of Search ..... 220/90.2, 90.4, 90.6, 220/90.2; 229/7 S; 215/1 A

[56] References Cited

U.S. PATENT DOCUMENTS

| | | | |
|---|---|---|---|
| 3,099,565 | 7/1963 | Neuhauser | 215/1 A X |
| 3,291,331 | 12/1966 | Grisham et al. | 215/1 A |
| 3,656,654 | 4/1972 | Brinkley, III | 220/90.2 |
| 4,109,817 | 8/1978 | Payne et al. | 220/90.2 |
| 4,228,913 | 10/1980 | Mack et al. | 229/7 S X |

FOREIGN PATENT DOCUMENTS

| | | | |
|---|---|---|---|
| 1136439 | 5/1957 | France | 215/1 A |

*Primary Examiner*—Steven M. Pollard

[57] ABSTRACT

An orifice which is an integral part of or attached to the underside of a beverage container top surface allows a corrugated straw with an air chamber near its bottom to emerge when the beverage container is opened with a specially-constructed pull tab assembly, whereupon said air chamber, being firmly attached to or a formed part of said straw, seats in a narrow area of said orifice permitting extension ofthe corrugated straw enabling one to drink the beverage container's complete liquid content through said straw without contact of mouth to container.

1 Claim, 3 Drawing Figures

SAN-I-CAN (A BEVERAGE CONTAINER INCORPORATING ITS OWN STRAW)

BACKGROUND OF THE INVENTION

1. Field of the Invention

This invention relates to a beverage container that incorporates its own straw. Upon opening the container, a straw would be made available immediately so as to provide a sanitary means of beverage consumption.

2. Description of the Prior Art

Containers with tubes and drinking straws have been known for years and are taught in various U.S. patents. However, in none of the prescribed devices does there exist an orifice, as an integral part of or attached to the underside of a beverage container top surface, sufficient in design to allow optimal consumption of the liquid within the beverage container through a corrugated straw with an air chamber near its bottom once the container is opened.

BRIEF SUMMARY OF THE INVENTION

The object of the present invention is, therefore, successfully to provide a self-contained straw within an existing beverage container which, by means of a unique orifice in said container and air chamber near the bottom of said straw, permits the straw to emerge when an individual opens the container thus allowing him to drink the utmost beverage content of the container through the straw without contact of mouth to container thereby facilitating a more sanitary drinking situation.

BRIEF DESCRIPTION OF THE DRAWINGS

The accompanying drawings, which constitute a part of this specification, illustrate conceptualization of this invention, wherein.

DETAILED DESCRIPTION OF THE INVENTION

Figure 1:
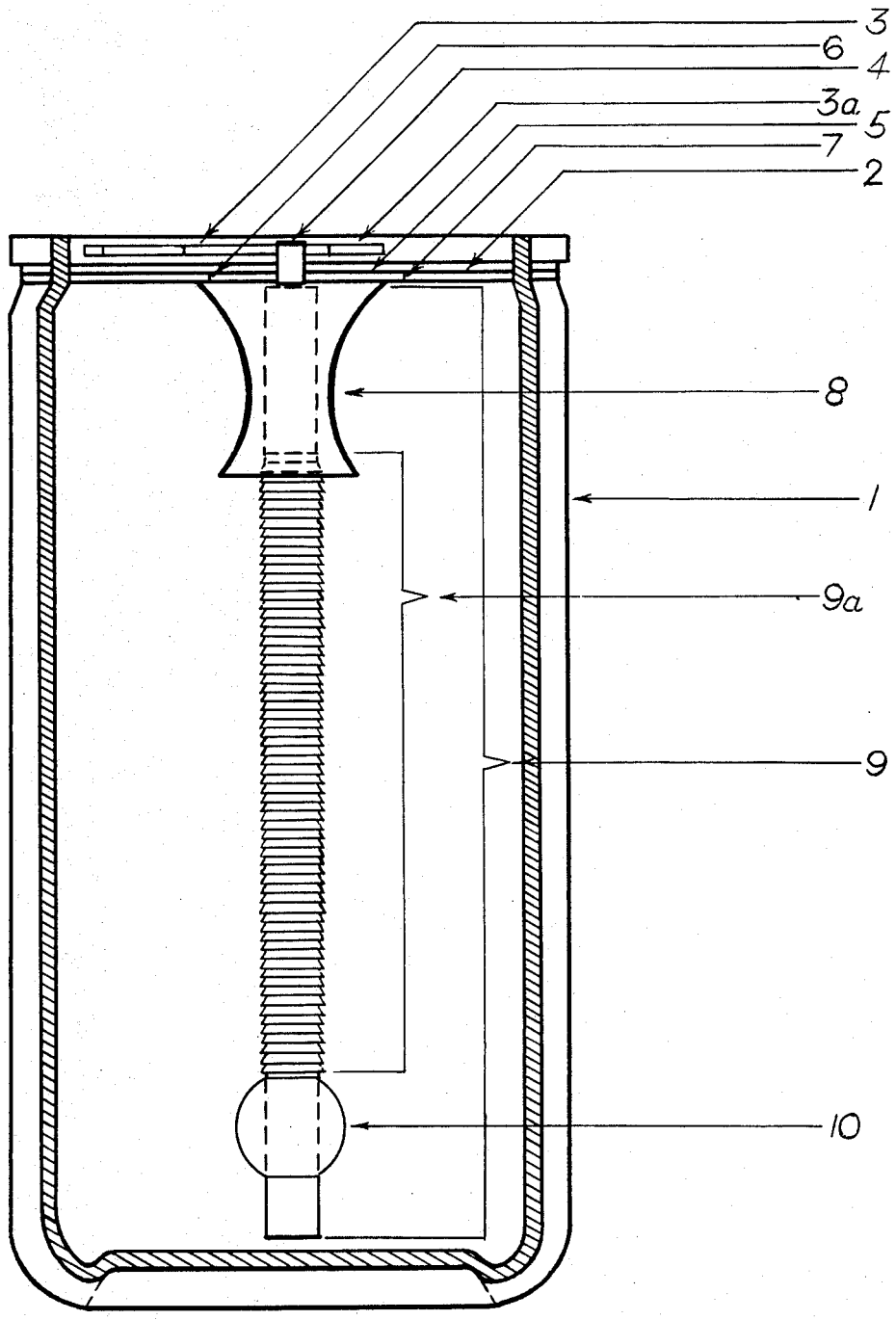
FIG. 1 is a cut-away elevational view of the invention in the closed position taken along line I—I of FIG. 2.
Figure 2:
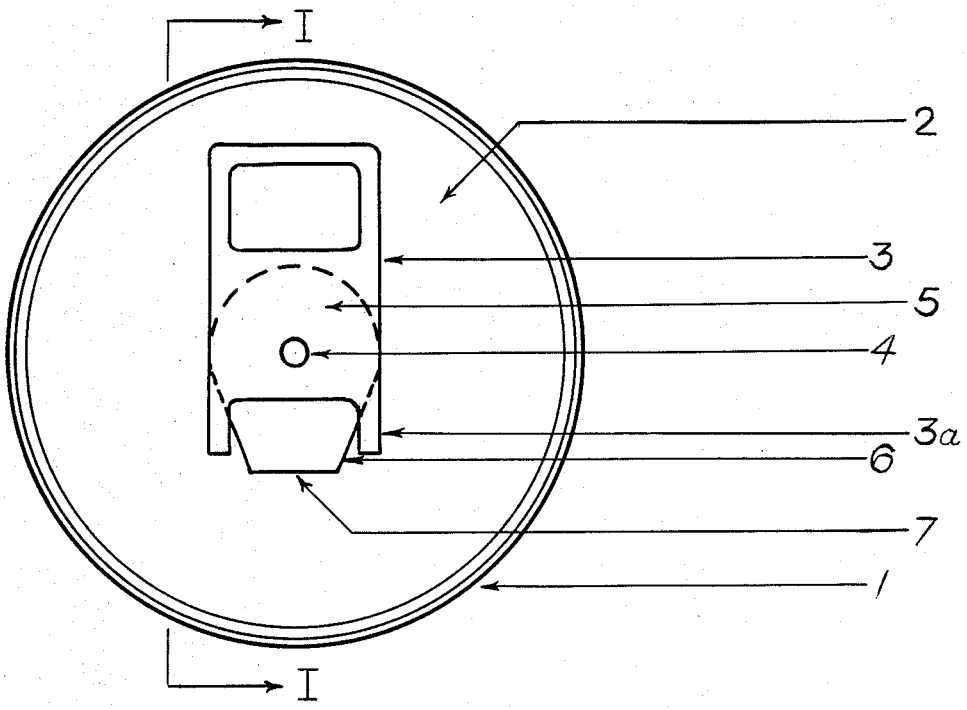
FIG. 2 is an exterior top view of the invention in the closed position.

Reference will now be made in detail to the invention, examples of which are illustrated in the accompanying drawings. Referring to FIG. 1, taken along line I—I of FIG. 2, wherein the reference numeral (1) represents a typical aluminum or steel beverage container conventional and common in the metal can industry, in which the top surface area (2) forms a sealing structure incorporating a suitable opening device. FIG. 2 best represents this sealing structure composed of said top surface area (2) and said suitable opening device: comprised of a pull tab (3) with special cleats (3*a*), a rivet (4) which fastens the pull tab (3) to a flap (5). To facilitate easy opening, this flap (5) has a scored area (6) in conjunction with the fold area (7).

Referring back to FIG. 1, taken along line I—I of FIG. 2, the beverage container (1)—shown in FIG. 1—is in closed position with the aforementioned top surface area (2), pull tab (3), cleats (3*a*), rivet (4), flap (5), scored area (6), and fold area (7). As represented in this cutaway view of FIG. 1, the orifice (8) formed of suitable material and attached to or incorporated with the underside of the top surface area (2) accommodates and stabilizes a full-length flexible, extendable straw (9) also of suitable material and designed to utilize an air chamber (10).

Figure 3:
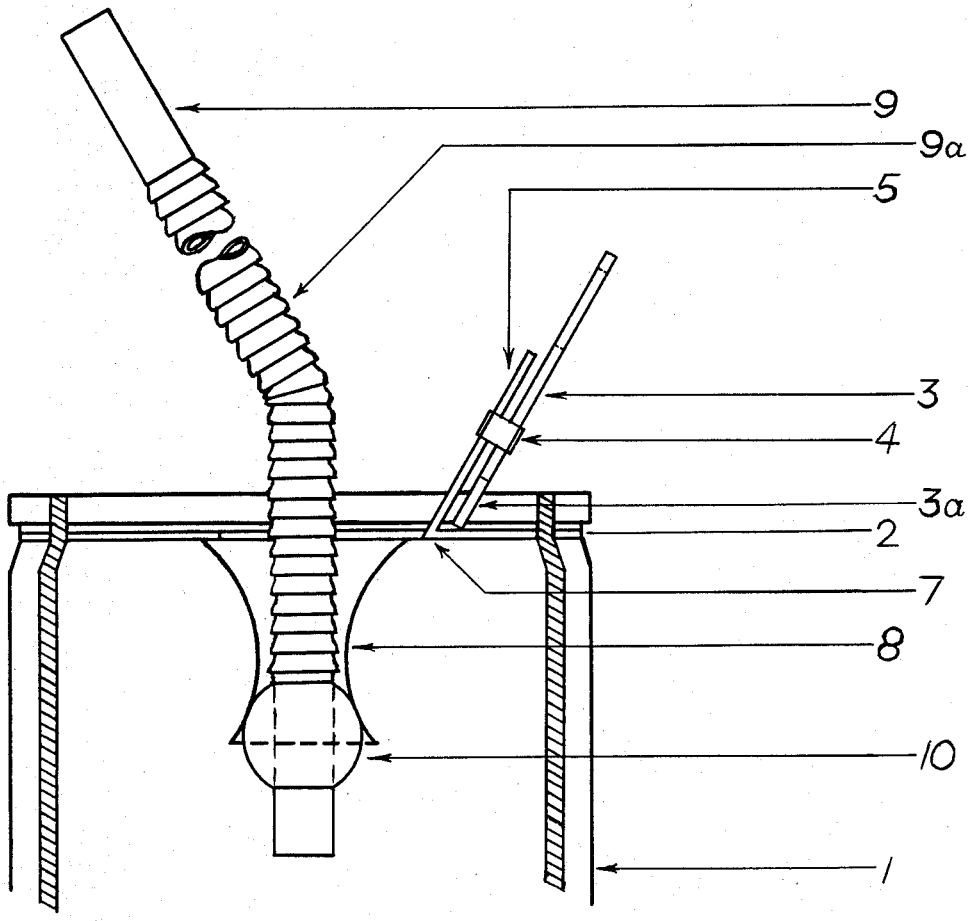
FIG. 3 is a cut-away fragmentary view of the invention taken along line I—I of FIG. 2. It shows the invention in open, operative position with the straw bent at a 30° angle.

Referring to FIG. 3, taken along line I—I of FIG. 2, the beverage container (1) is presented in the open, operable mode. The pull tab (3) attached to the flap (5) with a rivet (4) has been lifted up and back by leverage points afforded at the cleats (3*a*) against the top surface area (2) to allow separation between the flap (5) and the top surface area (2) via the scored area (6) (which is shown in FIG. 2.), thus opening the beverage container (1) while permitting the entire opening device to remain attached at the fold area (7). Simultaneous with opening of the beverage container (1) is emergence of the straw (9). The straw's immediate movement upward is attributable to the air chamber (10) located near the bottom of said straw (9). Air contained within the air chamber (10) provides buoyancy in the liquid environment sufficient to float the straw (9) upward through the orifice (8) where it is captured in the seated position shown in FIG. 3. From said seated position, straw (9) has been extended, said extendibility being a feature of the corrugated area of the straw (9*a*). The orifice (8) is so presented that its flared top is generally larger than the diameter of the opening of the beverage container at the scored area (6) (shown in FIG. 2) so as to allow a means of attachment or integral composition of said orifice (8) with the underside of the top surface area (2). In FIG. 3, straw (9) is shown bent at a 30° angle, however, it can be variously maneuvered for drinking convenience and complete consumption of the liquid within the beverage container. The corrugated area (9*a*) of the straw (9) can be seen in its entirety, non-extended, in FIG. 1.

Be it noted that the configuration of the orifice may vary to some extent as long as the functional properties as set forth in the invention are retained.

Be it also noted that the length of the straw in relation to the size of can is critical to the invention inasmuch as too short a straw would permit straw to be dislodged from orifice during such times as shipping and handling.

Be it finally noted that while materials and shapes may differ without essentially modifying the invention, the spherical shape is probably the preferred embodiment of the air chamber which may be a formed component of the straw or which may be attached to the straw firmly depending upon manufacturing techniques.

Although changes may be incorporated in the design, it is hoped that said changes will not alter the scope of the invention as to what is claimed.

What is claimed:

1. A straw assembly device adapted for suitably optimal beverage consumption within a liquid container of the type having a top surface wall with a pull-tab closure over an opening therein, a hollow shaped containing body, and a bottom surface wall, said assembly device comprising in combination:

(a) a flexible, extendible corrugated drinking drinking straw with a buoyant air chamber mounted near its bottom portion, (b) means for allowing variable positioning of said straw within the confines of said beverage container consisting of an orifice, attached to or integrally a part of the underside of said top surface wall of said beverage container in alignment with said opening, comprising a sufficiently constructed shape to slidably receive a straw said orifice being wider at its top, narrow near its midpoint, and belling near its bottom, while possessing a circular cross-sectional diameter at any given longitudinal point that a plane may be passed perpendicular to its vertical axis whereby said straw, once said beverage container has been opened and said straw manually extended, may be axially moved toward any convenient locality within the confines of said beverage container, (c) means to consume the optimal amount of liquid within said beverage container comprising said axial movement of said manually extended straw slidably received by said orifice while said beverage container is in open position whereby said straw may be so placed to consume the utmost amount of liquid within said beverage container.

* * * * *